United States Patent [19]

Rountree

[11] 4,328,271

[45] May 4, 1982

[54] SWAGGED TABLECLOTH

[76] Inventor: Jean Rountree, 851 N. Michigan Ave., Pasadena, Calif. 91104

[21] Appl. No.: 951,640

[22] Filed: Oct. 16, 1978

[51] Int. Cl.[3] ..... A47H 13/14; B32B 3/18

[52] U.S. Cl. ..... 428/66; 428/130; 428/192; 428/193; 428/101; 156/70; 160/348

[58] Field of Search ..... 428/64, 66, 101, 130, 428/192, 193; 156/70; 160/348

[56] References Cited

U.S. PATENT DOCUMENTS

| | | | |
|---|---|---|---|
| 2,484,340 | 10/1949 | Gardner | 156/70 |
| 3,196,757 | 7/1965 | Samways | 156/70 |
| 3,791,436 | 2/1974 | Weckbrodt | 160/348 |
| 3,952,788 | 4/1976 | Scholer | 160/348 |
| 3,963,067 | 6/1976 | Scholer | 160/348 |

*Primary Examiner*—George F. Lesmes
*Assistant Examiner*—Alexander S. Thomas
*Attorney, Agent, or Firm*—John Joseph Hall

[57] ABSTRACT

A swagged tablecloth having a plurality of shirring tape members provided with pull strings for removably providing the tablecloth with swagging as desired, allowing for easy laundering and flat storage.

5 Claims, 6 Drawing Figures

SWAGGED TABLECLOTH

SUMMARY OF THE INVENTION

The invention comprises a swagged tablecloth having a size greater than the table being covered, and provided with a plurality of shirring tape members and pull strings at various locations of its outside perimeter for removably drawing up a portion of the tablecloth at these locations. In this manner, a tablecloth may be provided with means for producing a swagging appearance at various locations of its perimeter.

It is, therefore, an object of this invention to provide a tablecloth which has means for drawing up portions of its perimeter at various locations to produce a swagging appearance.

Another object of this invention is to provide a swagged tablecloth which can be easily constructed from readily available materials for either a rectangular or round table.

A further object of this invention is to provide a tablecloth which has removably drawn up portions at various locations in its perimeter, so that a swagged appearance may be produced or removed as desired, to allow ease of laundering and flat storage.

These and other objects will be more readily understood by reference to the accompanying drawing, in which FIG. 1 is a perspective view of an embodiment of the invention in place on a table in a swagged position.

Figure 1:
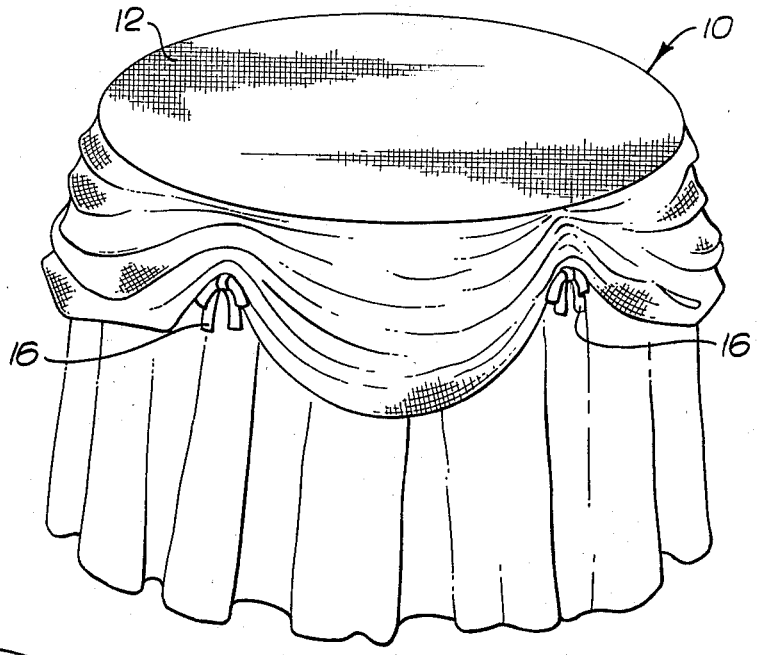
Figure 2:
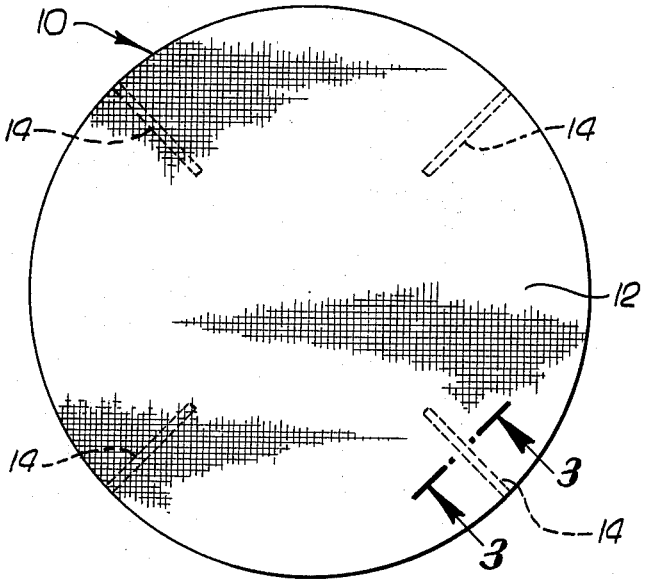
FIG. 2 is a plane view of FIG. 1.
Figure 3:
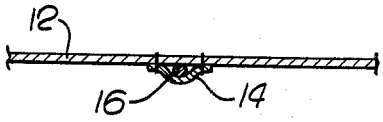
FIG. 3 is a view taken on line 3—3 of FIG. 2.
Figure 6:
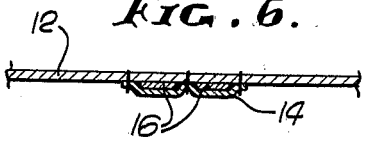
FIG. 6 is a view taken on line 6—6 of FIG. 5.

The tablecloth 10 is constructed from a sheet 12 of cloth or other suitable material. To properly fit a table, the sheet 12 is preferably cut to a size about 3 feet longer and about 3 feet wider than the table if the table is square or rectangular in shape, or 3 feet larger in diameter for a round table. For example, for a 30 inch square table, the sheet 12 was cut to a size 66 inches square. For a round table 30 inches in diamter, the sheet 12 was cut to a circle size having a diameter of 66 inches. FIG. 1 shows a swagged tablecloth for a round table.

The sheet 12 is provided with shirring tape members 14 and strings 16 at a plurality of locations on the back of sheet 12, preferably along a radius in the case of a round table, and in the case of a rectangular or square sheet, two shirring tape members 14 are provided at each corner as the inside sides of a square about 18 inches long at each corner of the tablecloth. In the case of a round tablecloth 10, the shirring tape members 14 preferably extend along a radius from the perimeter of sheet 12 towards the center of sheet 12 in a length of about 18 inches, or about 30% of the diameter of sheet 12, at 4 locations equally spaced around the circumference of sheet 12.

Figure 4:
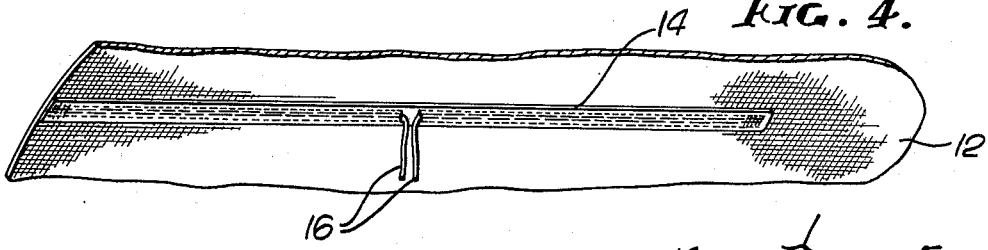
FIG. 4 is a detailed section of an embodiment of the invention showing the construction of the shirring tape member with pull strings located in its middle section.
Figure 5:
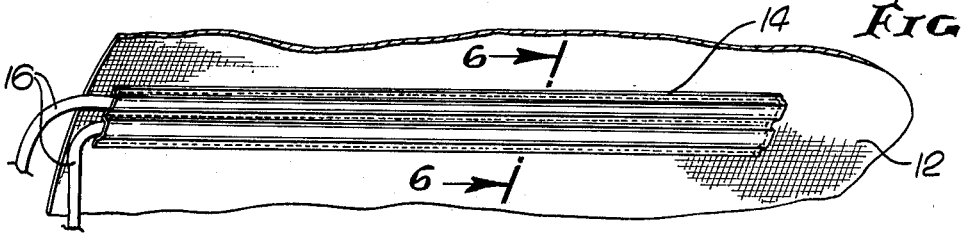
FIG. 5 is a detailed section of a shirring tape member attached to a portion of the tablecloth with pull strings at the outer end of the shirring tape member.

Tape members 14 enclose strings 16 which may be pulled and tied. Alternate constructions are shown in FIG. 4, where the ends of strings 16 appear in the middle of tape member 14 and in FIG. 5, where the ends of strings 16 are located at the outer end of tape member 14. Tape member 14 is preferably located on the back of sheet 12, and is attached by any suitable means such as sewing and the like. Various suitable materials may be used for the tape member 14 and strings 16.

In use, the tablecloth 10 is placed in position on a table as shown in FIG. 1, and the strings 16 are pulled and tied as desired. The tablecloth 12 may be used either with or without the tying of strings 16 to produce a swagged appearance as desired.

Although I have described the preferred embodiment of my invention, it is understood that numerous changes in construction and arrangement of parts may be made within the scope of my invention as hereinafter claimed.

I claim:

1. A swagged tablecloth comprising a pliable circular sheet member having a plurality of non-parallel shirring tape members, said shirring tape members being disposed radially about the circumference of said circular sheet member, said shirring tape members being provided with pull string members for maintaining said tablecloth in a swagged condition, said shirring tape members fully enclosing said pull string members up to the ends of said pull string members.

2. A tablecloth according to claim 1 in which the length of said shirring tape members is approximately 30% of the diameter of said circular tablecloth.

3. A tablecloth according to claim 1 which may be easily laundered and stored flat by releasing pull string members.

4. A swagged tablecloth comprising a pliable rectangular sheet member having a plurality of non-parallel shirring tape members, one of said shirring tape members being located at each corner of the perimeter of said sheet member, said shirring tape members being provided with pull string members for maintaining said tablecloth in a swagged condition, said shirring tape members fully enclosing said pull string members up to the ends of said pull string members.

5. A tablecloth according to claim 1 which may be easily laundered and stored flat by releasing pull string members.

* * * * *